United States Patent [19]

Ubukata et al.

[11] Patent Number: 5,021,618

[45] Date of Patent: Jun. 4, 1991

[54] ACCELERATION RESPONSIVE SWITCH

[75] Inventors: Susumu Ubukata, Kabushiki Kaisha Ubukata Seisakusho 4-30, Hosho-cho, Minami-ku, Nagoya-shi, Aichi-ken; Yasukazu Mizutani; Shigekazu Shibata, both of Nagoya, all of Japan

[73] Assignee: Susumu Ubukata, Nagoya, Japan

[21] Appl. No.: 478,947

[22] Filed: Feb. 12, 1990

[30] Foreign Application Priority Data

Feb. 12, 1989 [JP] Japan ..... 1-31737

[51] Int. Cl.[5] ..... H01H 35/14; H01H 29/02

[52] U.S. Cl. ..... 200/61.47; 200/233; 200/235

[58] Field of Search ..... 200/61.47, 182, 186, 200/214, 215, 220–225, 228, 231–236

[56] References Cited

U.S. PATENT DOCUMENTS 1,598,874 9/1926 Phelan ..... 200/235
1,826,570 10/1931 Phelan et al. ..... 200/220
3,351,726 11/1967 Cook ..... 200/220 X
4,135,067 1/1979 Bitko ..... 200/61.47 X

FOREIGN PATENT DOCUMENTS 488953 1/1930 Fed. Rep. of Germany ..... 200/236

*Primary Examiner*—J. R. Scott
*Attorney, Agent, or Firm*—Foley & Lardner

[57] ABSTRACT

An acceleration responsive switch, for operating an air bag system installed in an automobile, includes a cylindrical receptacle for containing an electrically conductive liquid such as mercury and an inert gas, a metallic lid having an open end and hermetically secured to the open end of the receptacle, and a pair of electrodes having one ends extended into the receptacle through the open end of the lid, respectively such that the one ends of the electrodes are brought into contact with the conductive liquid when a shock acting on the receptacle causes the conductive liquid to move within the receptacle.

6 Claims, 5 Drawing Sheets

ACCELERATION RESPONSIVE SWITCH

BACKGROUND OF THE INVENTION

This invention relates to an acceleration responsive switch which closes contacts in response to positive or negative acceleration occurred in the case of crash of an automobile or the like, so that a protection system such as air bag system for a driver or passengers may be operated.

Various types of the above-described acceleration responsive switches have been proposed. For example, one of them comprises a spherical inertial member serving as a solid pendulum for closing switch contacts. Another type employs combination of a pressure sensor and an electronic circuit. Further another type comprises a hermetically sealed glass receptacle containing mercury.

The electronic circuitry employed in prior acceleration responsive switches may fail under the influence of a pulsed high voltage due to discharge of static electricity induced during the driving of an automobile or an abnormal high current and high voltage induced in the case of a thunderbolt. Thus, the prior art switches employing the combination of the pressure sensor and electronic circuit have a reliability problem. In the case of the acceleration responsive switch of the type wherein the contacts are operated through a link mechanism by the solid inertial member, a long time use of the switch causes the contact fault and malfunction of the link mechanism. These faults cannot be found with ease and, accordingly, the switch has a problem that it is likely not to be energized when necessary. Further, the switch including an air-tightly sealed glass receptacle containing mercury has a problem of variations in operating characteristics. Additionally, since the glass receptacle is likely to be damaged, it is difficult to handle the switch. Moreover, even when the glass receptacle has a minute crack, it cannot be found at the beginning of use. A long time use of the switch enlarges the crack, which causes leakage of the charged gas and mercury.

SUMMARY OF THE INVENTION

Therefore, an object of the present invention is to provide an acceleration responsive switch wherein a receptacle for containing switch elements is rugged, has a high degree of air-tightness and can provide high reliability for a long period.

Another object of the invention is to provide an acceleration responsive switch wherein variations of switch on-state holding period, in the case where the switch is operated in response to the acceleration, can be reduced.

Another object of the invention is to provide an acceleration responsive switch which can be prevented from malfunctioning even when the switching elements are subjected to vertical vibration.

Yet another object of the invention is to provide an acceleration responsive switch, wherein switching elements can be prevented from changing their operating characteristics because of mechanical or thermal shocks, thereby providing for high reliability.

The present invention provides an acceleration responsive switch comprising a cylindrical receptacle for containing an electrically conductive liquid including mercury and an inert gas for preventing the conductive liquid from changing in quality, a metallic lid member, and a pair of electrodes. The receptacle has an open end and is formed from a metallic material which will not amalgamate with the mercury of the conductive liquid. The inner surface of the receptacle is roughened, so that adhesion of the conductive liquid thereto is reduced and the rolling of the conductive liquid thereon is enhanced. The metallic lid member has an aperture, and is hermetically secured, at an edge of the aperture thereof, to the open end of the receptacle. The electrodes have one end extended into the receptacle through the open end, extended into the receptacle through the aperture of the lid member such that the one end of the electrodes are brought into contact with the conductive liquid when a shock acting on the receptacle causes the conductive liquid to move within the receptacle. The electrodes are hermetically retained in the interior of the lid member by an electrically insulative material hermetically charged in the interior of the lid member. The electrodes are opposite to each other in the receptacle. The ends of the electrodes to be brought into contact with the conductive liquid include generally L-shaped portions which are amalgamated with the mercury of the conductive liquid to thereby serve as wet portions, respectively. The wet portions are parallel to each other. The distance between the wet portions is determined so as to prevent the wet portions from being bridged by the conductive liquid and has a value smaller than those between the wet portions and the inner surface of the receptacle.

In accordance with the present invention, the metallic receptacle is employed for containing the inert gas and the conductive liquid together with the electrodes, instead of the glass receptacle which is likely to have cracks or crack. Accordingly, even when the switch is subjected to the mechanical shocks and thermal stress during assembling steps or in practical use, damage, such as a crack reducing the airtightness of the receptacle, may be prevented. Consequently, variations of the operating characteristic of the switch may be restricted to a small range, and stable operation of the switch may be ensured substantially permanently.

Since the roughed inner surface of the receptacle reduces adherence of the conductive liquid thereto, the conductive liquid may be prevented from bridging the receptacle inner surface and the electrodes even when the distances between the receptacle inner surface and the electrodes have small values. Thus, since the space between the receptacle inner surface and the electrodes may be narrowed, the receptacle may be rendered more slender and the conductive fluid may be prevented from vertically vibrating. This advantage confirms that the switch is responsive to the horizontal acceleration as a detected object, but not to vertical acceleration, and that the range of variations of the switch on-state holding period may be narrowed.

Ends of the electrodes which are brought into contact with the conductive liquid to, thereby, make electrical contacts are each bent into a generally L-shaped form. As a result, the electrodes may be held symmetrical to each other relative to the center of the open end of the receptacle or the center of the lid member. Such a disposition of the electrodes as described above renders it easy to make the acceleration responsive switch and prevents occurrence of residual stress which causes aged deterioration of a portion of each electrode where it is supported.

Other objects of the present invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENT

Figure 1:
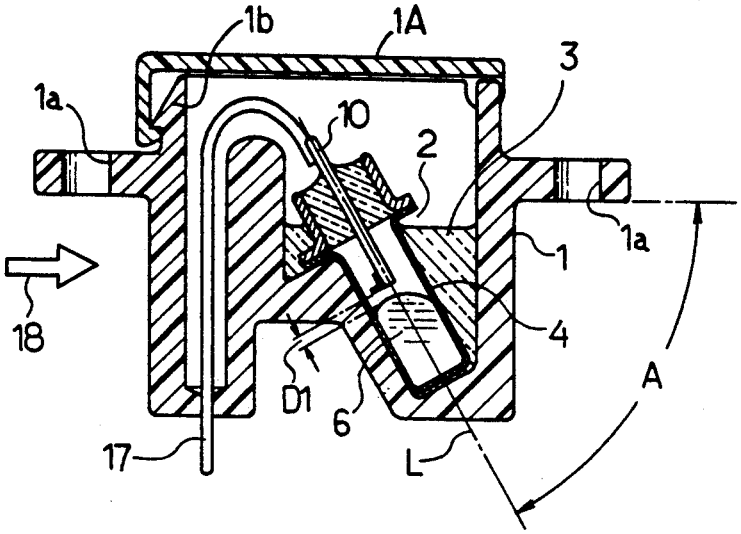
FIG. 1 is a longitudinal cross section of an acceleration responsive switch of an embodiment in accordance with the invention.

Embodiments of the acceleration responsive switch in accordance with the invention will be described with the accompanying drawings. Referring first to FIG. 1, a casing 1 formed of a synthetic resin has a plurality of mounting portions 1*a* at which the acceleration responsive switch is mounted on an automobile body or the like. The casing 1 has an opening 1*b*, closed by a cover 1*a* formed from a plastic material. Switching elements 2 are secured to the interior of casing 1 by an adhesive 3 such that a central axis L of switching elements 2 is inclined by an angle A relative to a horizontal plane or mounting plane. Casing 1 is generally mounted on a horizontal plane of an automobile or the like. However, when casing 1 is mounted on an inclined plane, the angle A may be changed. As shown in detail in FIGS. 2 and 3, a bottomed cylindrical receptacle 4 is formed of a steel plate and has an upper open end 5. Cylindrical receptacle 4 has a roughed inner surface if, which surface may be obtained by chemically etching the inner surface with nitric acid or the like or by mechanically spraying the receptacle's inner surface a liquid containing minute grains of whetstone or grindstone to form microscopic projections and recesses on the surface. A suitable roughed inner surface has sharp projections 1*d* and recesses 1*c* having the height and width each ranging from 2 μm to 5 μm further on a large waving rough surface if having the width ranging from 50 to 100 μm and the height of approximately 10 μm, as shown in FIG. 2A. A predetermined amount of an electrically conductive liquid 6 comprising mercury and thallium is contained in receptacle 4, as is well known in the art. A tubular lid member 7 has an outwardly bent edge portion 8 and is formed from an iron, cobalt and nickel alloy or Kovar, in consideration of its thermal expansion coefficient. A pair of bar-shaped electrodes 10 formed from tungsten are disposed through the hollow interior 7*a* of lid member 7 so as to be symmetrical to each other relative to the center of the interior 7*a*. An electrical insulating member 9 such as boro-silicated glass is charged into interior 7*a* in its melted state. Subsequently, insulating member 9 is cooled, thereby hermetically securing electrodes 10 in position, as well known in the art. Edge portion 8 of lid member 7 is hermetically secured to the peripheral edge of open end 5 of receptacle 4 in a manner as will be described later.

A deterioration preventive gas G consisting of an inert gas belonging to the group 0 in the periodic table of elements, such as helium and an unoxidized hydrogen gas is charged into the interior of receptacle 4 by replacing air in the receptacle interior therewith. A wet chip 11 is secured to the lower end of each electrode 10 by spot welding, as viewed in FIGS. 2 and 3. Each wet chip 11 is formed of a nickel plate formed into a generally L-shape. Each wet chip 11 has on the surface a plated gold layer the thickness of which is approximately 0.3 μm. Alternatively, when each wet chip 11 is formed of a narrow thin iron plate, a nickel plating of approximately 1 μm thick and then, gold plating of approximately 0.3 μm thick may be applied to the surface of the iron plate. In this case, the gold plating is applied to each wet chip 11 because the nickel surface is oxidized in the atmosphere of air, resulting in a passive state of each wet chip 11. The passive state prevents each electrode 10 from being wet with conductive liquid 6. The gold-plating is employed for covering the nickel surface for the purpose of preventing such inconvenience.

Figure 2:
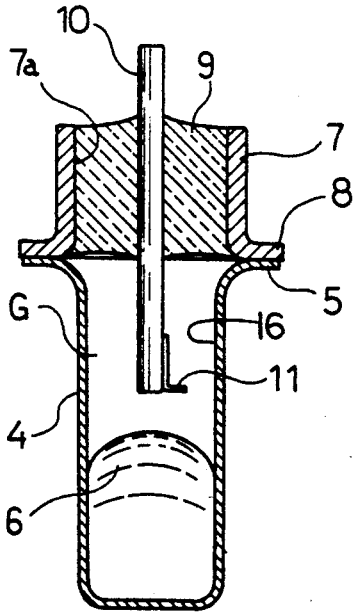
FIG. 2 is an enlarged longitudinal cross section of switching elements of the switch in FIG. 1.
Figure 3:
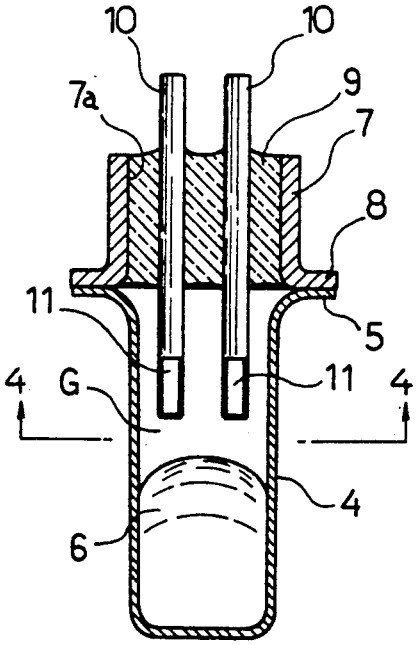
FIG. 3 is a view similar to FIG. 2 showing a view as seen from the angle 90 degrees different from that of FIG. 2.
Figure 2A:
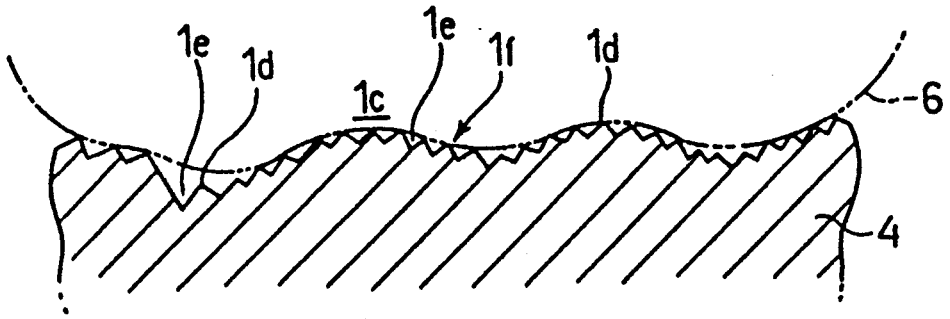
FIG. 2A is an enlarged view of the roughened inner surface of a receptacle.

Lid member 7 is formed from Kovar in the embodiment shown in FIGS. 2 and 3. Bar-shaped tungsten electrodes 10 are inserted through the interior 7*a* of lid member 7 and secured in position by insulating material 9 such as boro-silicated glass. In the embodiment, thermal expansion coefficients of lid member 7, insulating material 9 and electrodes 10 are matched so that a so-called matching type hermetic sealing is provided. In this case, the retention of airtightness is superior. Although a tungsten electrode has fine conductivity, it is hard and likely to be broken when forcedly bent. Therefore, a wet chip 11 as an independent part is secured to each electrode 10, thereby obtaining an L-shaped bent portion. On the other hand, in a so-called compressive hermetic seal, a thick iron disc is employed as lid member 12 in another embodiment shown in FIGS. 6 and 7. Two through-holes 12*a* and 12*b* are formed in lid member 12. Electrodes 13 and 14 each formed of an iron-nickel alloy or iron-chromium alloy are inserted through holes 12*a* and 12*b*, respectively and secured in position by charging respective insulating materials 15 and 16 each comprising a soda-lime glass or ceramics with the electrodes electrically insulated. These materials have differences in the thermal expansion coefficients. The insulating materials are melted and a compressive force acts against holes 12*a* and 12*b*, insulating materials 15 and 16 and electrodes 13 and 14, in turn, thereby providing complete sealing by making use of the difference in the thermal expansion coefficients.

Figure 6:
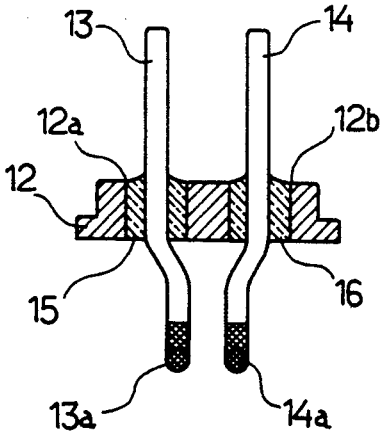
FIG. 6 is a longitudinal cross section of the lid member and switching elements of the acceleration responsive switch of another embodiment.
Figure 7:
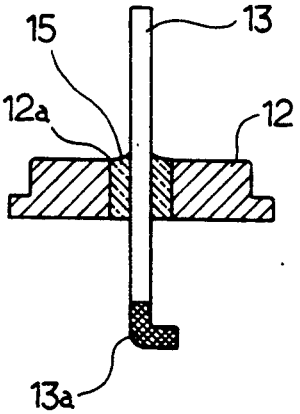
FIG. 7 is a view similar to FIG. 6 showing a view seen from the angle 90 degrees different from that of FIG. 6.

Since the iron-nickel alloy or iron-chromium alloy employed for the material of the electrodes can be bent with ease, wet chips 11 as employed in the foregoing embodiment shown in FIGS. 2 and 3 are not needed and instead, ends of the electrodes positioned in the receptacle are bent. The nickel plating and, then, the gold plating are applied to crosshatched L-shaped portions 13*a* and 14*a* in the manner same as applied to wet chips 11, as shown in FIGS. 6 and 7. Since an electric specific resistance of this electrode material is higher than that of tungsten, it is preferable that Kovar be used.

Figure 8:
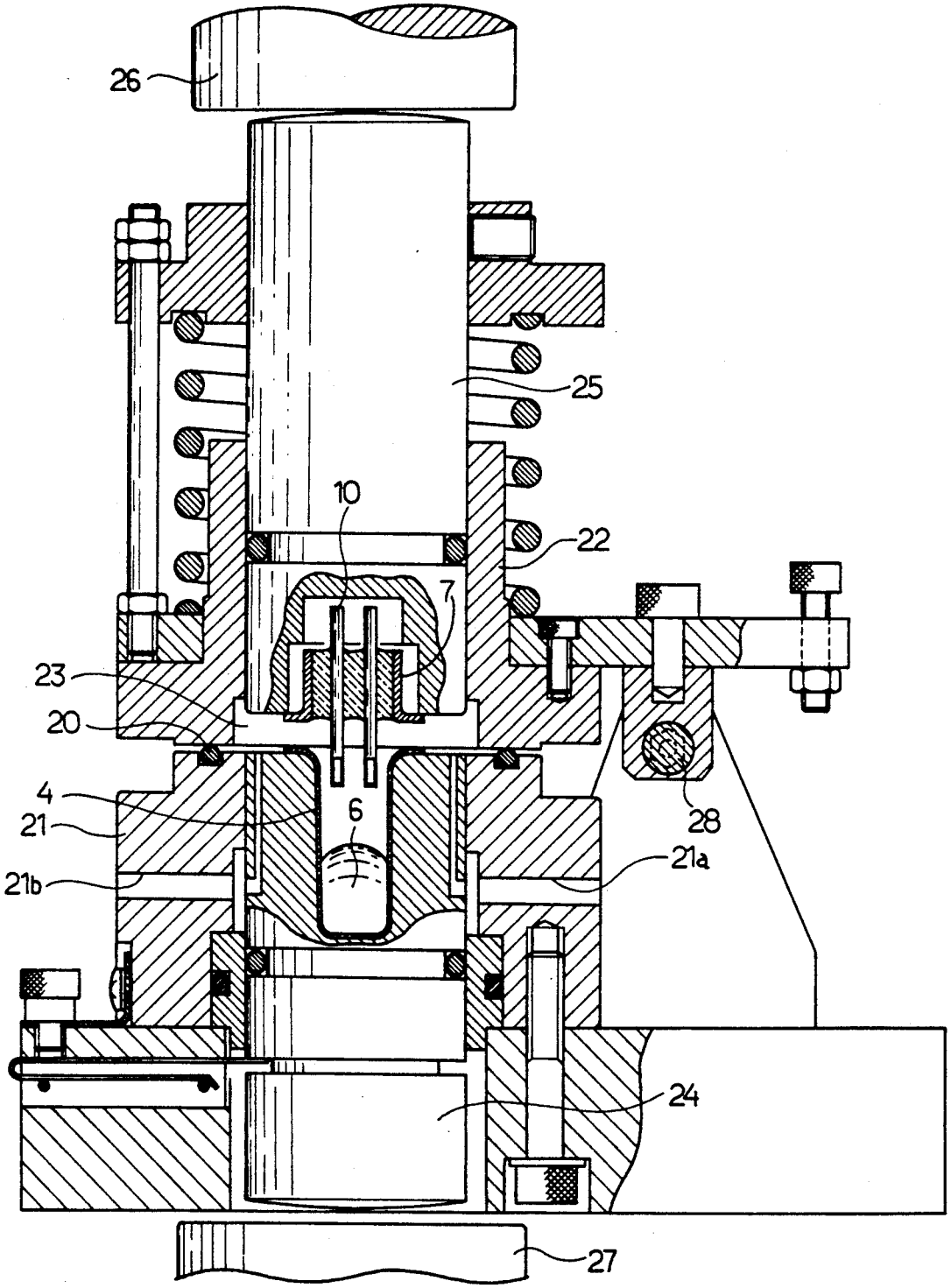
FIG. 8 is a partially cutaway longitudinal cross section of a major part of an apparatus for airtightly enclosing the switching elements of the switch.

A manner of making the above-described acceleration responsive switch will now be described with reference to FIG. 8. Switching element 2 is disposed in a chamber 23 surrounded by hollow lower and upper supports 21 and 22 having respective one open ends airtightly pressing against each other through a packing. In this disposition, cylindrical receptacle 4 containing the conductive liquid is held on a first chamber electrode 24 provided in the hollow portion of lower support for axially slidable movement. A lid member supporting a pair of electrodes 10 through an insulation is held on a second chamber electrode 25 provided in the hollow portion of upper support 22 for axially slidable movement so as to be away from the open end of receptacle 4. In this condition, a valve (not shown) provided in a passage 21*b* is closed and then, air in chamber is sucked by a vacuum pump (not shown) through a passage 21*a*. When the chamber interior reaches a predetermined degree of vacuum, the valve of passage 21*b* is opened with a valve (not shown) provided in passage 21*a* closed and an inert gas is supplied into the chamber 23 through a passage 21*b* from a gas supply source not shown, thereby filling the receptacle 4 with the inert gas.

Subsequently, a welding movable electrode 26 is lowered to second chamber electrode 25, thereby pushing the same downwardly. As a result, the peripheral edge of lid member 7 is caused to strike against open end edge 5 of receptacle 4 and, in this condition, first chamber electrode 24 is lowered until striking against a welding fixed electrode 27. When first chamber electrode 24 is struck against welding fixed electrode 27, a large pulsed current is induced between chamber electrodes 24 and 25, which welds receptacle 4 and lid member 7 hermetically. Upon completion of the welding, upper and lower supports 22 and 21 are removed together and upper support 22 is rotated in the clockwise direction about a shaft 28 as viewed in FIG. 8, thereby releasing chamber 23. More specifically, electrodes 24 and 25 forming chamber 23 are formed from an electrically conductive material such as a chromium-copper alloy. When an electric capacitor is discharged to the primary coil of transformer, a low-voltage large current is induced at the secondary coil of the transformer and flows across open end 5 of receptacle 4 and end 8 of lid member 7. Such an operation is performed by a welder of the capacitor discharging type. Thus, receptacle 4 and lid member 7 are hermetically coupled. A helium detector is employed for inspecting the airtightness of receptacle 4. The helium detector has such the sensitivity that an amount of gas leakage below 0.1 $cm^3$ for ten years may be detected in a short period. Thus, the helium detector assures the stable characteristics of the acceleration responsive switch of the invention for a long period.

In accordance with the acceleration responsive switch assembled as described above, gold plated on the wet chip 11 (or portions 13*a* and 14*a* in FIG. 6) is melted in conductive liquid 6 when electrodes 10 are brought into contact with the mercury in conductive liquid 6. Consequently, the mercury contains a slight amount of gold, and the nickel surface of wet chip 11 is brought into contact with conductive liquid 6 after the melting of gold on the wet chip surface. Accordingly, nickel forms an amalgam with mercury, and is rendered wet. The nickel portion of wet chip 11 is not melted by mercury and remains on the wet chip surface substantially permanently. Thus, an acceleration responsive switch with stable operation and a small value of contact resistance may be obtained. Synthetic resin casing 1 is mounted at mounting portions 1*a* on the body of an automobile so that switching element 2 is secured in the casing by adhesive such that the axis L thereof is inclined a predetermined angle A relative to the horizontal surface, as is shown in FIG. 1. Leads 17 are connected at one ends to respective electrodes 10 and at the other ends to a printed circuit board, for example.

Figure 9:
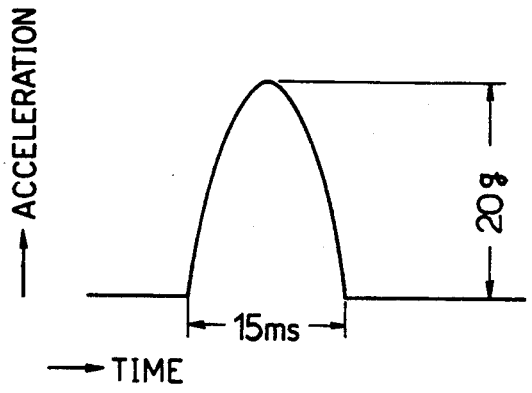
FIG. 9 illustrates an example of an acceleration waveform employed for measurement of a responsibility of the switch.

The characteristics of the acceleration responsive switch that are taken into consideration in the present invention will now be described. The inventors examined the response time of the acceleration responsive switch and its on-state holding period in the case where an acceleration having a half-period sine wave form peak value of 20 g (where 1 g=a gravitational acceleration unit) as shown in FIG. 9 is applied to the switch in the horizontal direction as shown in FIG. 1. Here, the response time refers to a period from the time when conductive liquid 6 starts moving along the inclined inner surface of receptacle 4 to the time when electrodes 10 are closed. The on-state holding period refers to a period during which electrodes 10 are maintained in the closed state. The inventors further examined the vibration frequency of vibration caused during a normal driving of the automobile, the acceleration and malfunctioning characteristics of the acceleration responsive switch.

Figure 4:
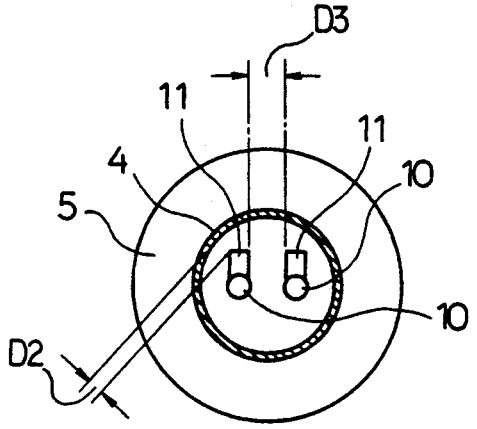
FIG. 4 is a transverse sectional view taken along line IV—IV in FIG. 3.
Figure 5:
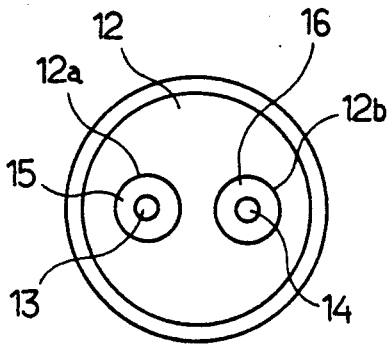
FIG. 5 is a top plan view of a lid member and switching elements of the acceleration responsive switch.
Figure 10:
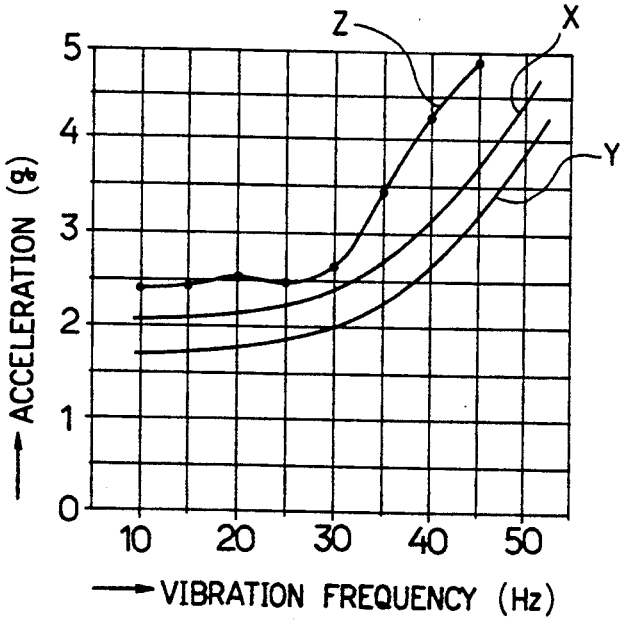
FIG. 10 is a graph showing the malfunction characteristic of the switch.

Reference symbol D1 in FIG. 1 designates the distance between ends of respective electrodes 10 and the surface of conductive liquid 6 of switching element 2 secured with angle A ranging from 60 to 65 degrees. Where the response time is desired to range from 6 to 8 milliseconds, the distance D1 takes the value of 1.5 millimeters. In this condition, when the distance D3 (see FIG. 4) between end portions of respective electrodes 10 wet with conductive liquid 6 has a value below 1.7 millimeters, conductive liquid 6 bridges the wet portions of electrodes 10, which does not open the electrical circuit. Further, conductive liquid 6 also bridges the wet portions of electrodes 10 when distance D2 between the inner surface of receptacle 4 and the distal end of wet portion of electrode 10 takes the value below 1.7 millimeters. For example, consider the case where each electrode has the diameter of 1 millimeter and the wet chip has a width smaller than the diameter of electrode 10 and further where the maximum dimension of the wet chip 11 does not exceed the diameter of electrode 10 and the L-shaped end protrudes by 1 millimeter from the electrode when conductive liquid 6 causes wet chip 11 to be wet such that the wet chip takes the maximum dimension. In this case, the inner surface diameter of receptacle 4 needs to take the value of 7.8 millimeters from the foregoing. However, when the inner surface diameter of receptacle 4 takes the value of 7 millimeters and above, deviations of the response time and on-state holding period are increased at every measurement. Further, the vibration induced during the normal driving of the automobile causes malfunction of the acceleration responsive switch. More specifically, the transverse axis in FIG. 10 designates the vibration frequency per second and the longitudinal axis denotes the acceleration value of vibration. An experiment shows that the acceleration responsive switch should not be responsive to the acceleration values below those corresponding to vibration frequencies represented by curve X while that conductive liquid 6 closes electrodes 10 below the acceleration values corresponding to vibration frequencies represented by curve Y, where an instantaneous closing of the electrodes having a period shorter than the on-state holding period necessary for the acceleration responsive switch to operate the air bag system is excluded.

However, the experiment confirms that the above-described inconveniences may be solved by roughing the inner surface of receptacle 4 containing conductive liquid 6 as described above. More specifically, in the case where receptacle 4 has the roughed inner surface, the roughness prevents conductive liquid 6 from bridging electrodes 10 even when the distance D2 between the receptacle inner surface and the end of electrode 10 or end of wet chip 11 is decreased to the value of 0.5 millimeters. Consequently, the inner surface diameter of receptacle 4 may be reduced to the value of 5 millimeters and may be selected from the range between 5 and 6.5 millimeters in accordance with the dimension of the wet portion of the electrode. As a result, the acceleration responsive switches having little deviation in the response time, on-state holding period, malfunction characteristic may be obtained. Actual measurement data shows a satisfactory characteristic represented by curve Z in FIG. 10 may be obtained in the case where the response time ranges from 6 to 8 milliseconds and the on-state holding period ranges from 35 to 45 milliseconds.

The foregoing disclosure and drawings are merely illustrative of the principles of the present invention and are not to be interpreted in a limiting sense. The only limitation is to be determined from the scope of the appended claims.

What we claim is:

1. An acceleration responsive switch comprising:

(a) a cylindrical receptacle for containing a predetermined amount of an electrically conductive liquid comprising mercury and further containing an inert gas for preventing the conductive liquid from changing in quality, said receptacle having an open end and being formed from a metallic material non-amalgamating with the mercury of the conductive liquid, said receptacle having a roughened inner surface so that the adhesion of the conductive liquid thereto is reduced and the rolling of the conductive liquid thereon is enhanced;

(b) a casing for holding said receptacle in a state inclined at a predetermined angle relative to a horizontal plane;

(c) a metallic lid member having a hollow interior and an edge portion and hermetically secured, at the edge portion thereof, to the peripheral edge of the open end of said receptacle; and (d) a pair of electrodes each having one end extended into said receptacle through said lid member such that said one ends of said electrodes are brought into contact with the conductive liquid when a shock acting on said receptacle causes the conductive liquid to move within said receptacle, said electrodes being hermetically retained in the hollow interior of said lid member by an electrically insulative material hermetically sealing the hollow interior of said lid member, said electrodes being substantially symmetrical to each other in said receptacle, said one ends of said respective electrodes to be brought into contact with the conductive liquid each including a generally L-shaped portion which is amalgamated with the mercury of the conductive liquid to thereby serve as a wet portion, each said L-shaped portion projecting in the direction in which said receptacle is inclined, said wet portions being parallel to each other with a distance therebetween determined so that the conductive liquid is prevented from bridging said wet portions, the distance between said wet portions having a value larger than those between each wet portion and the inner surface of said receptacle, whereby an acceleration responsive switch having little deviation in response time on-state holding period and malfunction characteristic is obtained.

2. An acceleration responsive switch according to claim 1, wherein each said wet portion comprises a generally L-shaped metallic strip secured to each said electrode.

3. An acceleration responsive switch according to claim 1, wherein the electrically conductive liquid includes therein gold, and the roughed inner surface of said receptacle includes a meanderingly projected and recessed portion and a microscopically projected and recessed portion formed on the meanderingly projected and recessed portion.

4. An acceleration responsive switch according to claim 1, wherein the distance between said wet portions and the distance between the receptacle inner surface and each wet portion are 1.7 millimeters or more.

5. An acceleration responsive switch according to claim 2, wherein said metallic strip is formed from a nickel member having a gold-plated surface.

6. An acceleration responsive switch according to claim 2, wherein said metallic strip has a nickel-plated surface further overlaying a gold-plated surface.

* * * * *